US007503795B2

(12) United States Patent
Yamaji et al.

(10) Patent No.: US 7,503,795 B2
(45) Date of Patent: Mar. 17, 2009

(54) CONNECTOR PREVENTED FROM UNDESIRED SEPARATION OF A LOCKING MEMBER

(75) Inventors: Takahiro Yamaji, Tokyo (JP); Koji Kawase, Tokyo (JP); Kazushi Kamata, Aomori (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/901,623

(22) Filed: Sep. 18, 2007

(65) Prior Publication Data

US 2008/0076282 A1 Mar. 27, 2008

(30) Foreign Application Priority Data

Sep. 21, 2006 (JP) ..... 2006-256085

(51) Int. Cl.
*H01R 13/627* (2006.01)

(52) U.S. Cl. ..... 439/358

(58) Field of Classification Search ..... 439/350–358
See application file for complete search history.

(56) References Cited

U.S. PATENT DOCUMENTS

2007/0049099 A1 * 3/2007 Potters ..... 439/352

FOREIGN PATENT DOCUMENTS

JP H5-11362 2/1993
JP 2005 267970 9/2005

* cited by examiner

*Primary Examiner*—Ross N Gushi
(74) *Attorney, Agent, or Firm*—Collard & Roe, P.C.

(57) ABSTRACT

In a connector including at least one contact and a housing holding the at least one contact, a locking member is received in a lock receiving portion of the housing and serves to lock a fitted state with a mating connector. The locking member includes a shaft portion. The lock receiving portion includes a bottom surface faced to the shaft portion in its axial direction and a side surface for guiding rotation of the shaft portion. At least one of the locking member and the lock receiving portion includes a spring portion pressing the shaft portion towards the bottom surface.

7 Claims, 5 Drawing Sheets

CONNECTOR PREVENTED FROM UNDESIRED SEPARATION OF A LOCKING MEMBER

This application is based upon and claims the benefit of priority from Japanese patent application No. 2006-256085, filed on Sep. 21, 2006, the disclosure of which is incorporated herein in its entirety by reference.

BACKGROUND OF THE INVENTION

This invention relates to a connector having a locking member for locking a fitted state between the connector and a mating connector.

For example, Japanese Unexamined Patent Application Publication (JP-A) No. 2005-267970 discloses a connector in which an insulator has a receiving portion adapted to receive a locking mechanism. The locking mechanism has a main body, a locking portion extending from one side of the main body, a spring portion extending from the other side of the main body to continuously urge the locking portion in an engaging direction in which the connector is engaged with a mating connector, and an operating portion for unlocking a locked state by the locking portion. The locking mechanism further has a shaft portion of a hole-like shape formed in the main body to be engaged with a rotation shaft of a pin-like shape formed in the receiving portion. By receiving the locking mechanism in the receiving portion, the rotation shaft and the shaft portion are engaged with each other. Thus, the locking mechanism is rotatably held by the insulator.

However, since the insulator is provided with the pin-like rotation shaft to be engaged with the hole-like shaft portion of the locking mechanism, it takes much time and labor to incorporate the locking mechanism into the insulator. This results in an inferior assemblability.

Japanese Unexamined Utility Model Application Publication (JP-U) No. H5-11362 discloses a male connector provided with a lock spring having an engaging claw and a press button formed at one end and the other end, respectively. The lock spring is fixed to a casing of the male connector at a generally intermediate position. The engaging claw protrudes from a connecting end face of the male connector. The press button protrudes on a lateral side of the casing of the male connector. When the press button is pressed inward into the casing, the lock spring is rotated and the engaging claw moves outward.

However, the engaging claw of the lock spring has elasticity so that the position of the engaging claw is unstable and the locking strength is not stable also. If a gap or play is present between the lock spring and the casing of the male connector, the lock spring can not perform smooth rotation. Further, the lock spring is readily released from the casing.

SUMMARY OF THE INVENTION

It is therefore an exemplary object of this invention to provide a connector which allows smooth rotation of a locking member and which is capable of preventing the locking member from being released from a housing.

It is another exemplary object of this invention to provide a connector which is capable of maintaining a constant amount of protrusion of a locking member when it is rotated to a locked state, so as to assure a stable locking strength.

Other objects of the present invention will become clear as the description proceeds.

According to an exemplary aspect of the present invention, there is provided a connector comprising at least one contact, a housing holding the at least one contact and having a lock receiving portion, and a locking member received in the lock receiving portion for locking a fitted state with a mating connector, wherein the locking member includes a shaft portion, the lock receiving portion includes a bottom surface faced to the shaft portion in its axial direction and a side surface for guiding rotation of the shaft portion; and at least one of the locking member and the lock receiving portion includes a spring portion pressing the shaft portion towards the bottom surface.

DESCRIPTION OF THE EXEMPLARY EMBODIMENT

Figure 1:
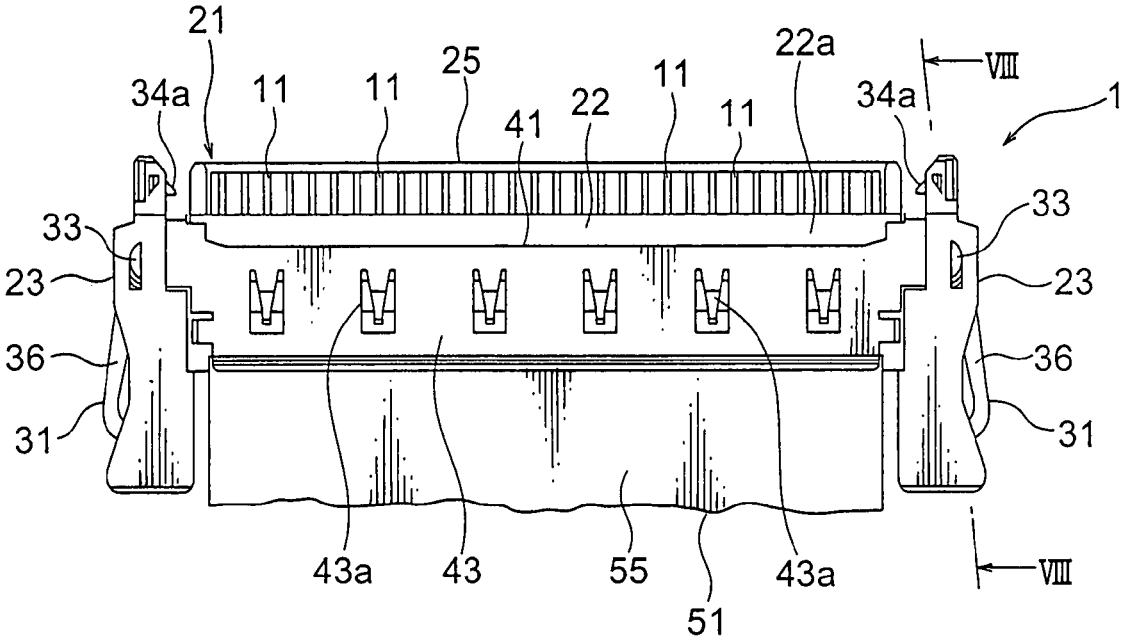
FIG. 1 is a plan view of a connector according to an exemplary embodiment of this invention when it is connected to a connection object.
Figure 2:
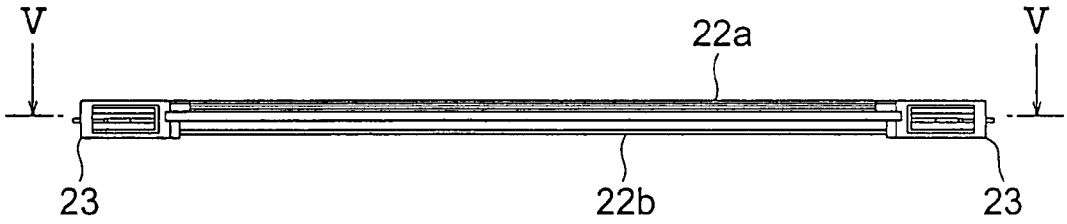
FIG. 2 is a front view of the connector illustrated in FIG. 1.
Figure 3:
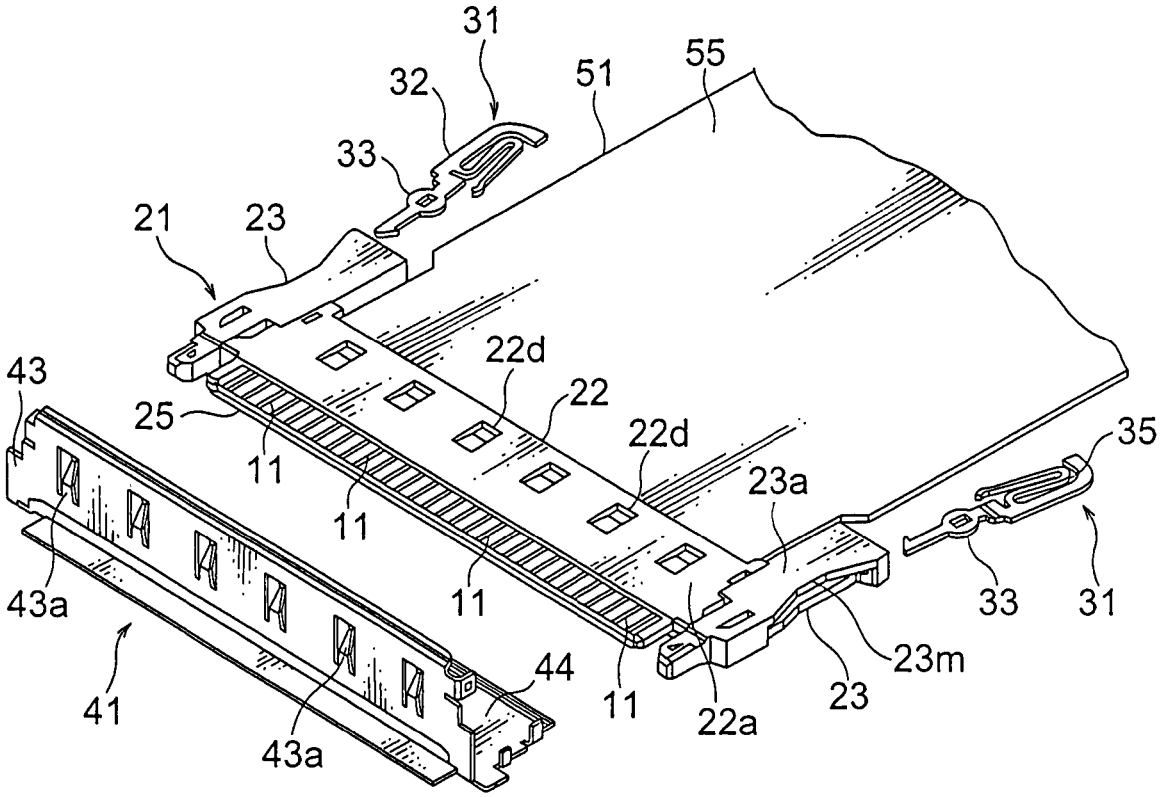
FIG. 3 is a perspective view of the connector illustrated in FIG. 1 before it is assembled.

Referring to FIGS. 1 to 3, description will be made of a connector according to an exemplary embodiment of this invention.

In FIGS. 1 to 3, a cable 51 such as a FFC (Flexible Flat Cable) as a connection object is connected to a connector 1. The cable 51 will hereinafter be called the flat cable 51. The flat cable 51 comprises a plurality of conductors (not shown) of a thin belt-like shape, such as a metal foil, arranged in parallel to one another with a space left therebetween, and a flexible insulator cover 55 clamping and holding the conductors.

The connector 1 comprises a plurality of contacts 11, an insulating housing 21 holding the contacts 11, and a pair of locking members 31 attached to the housing 21, and a conductive shell member 41 coupled to the housing 21. The housing 21 has a main body 22 of a generally rectangular plate-like shape, and a pair of lock receiving portions 23 formed on longitudinal opposite ends of the main body 22. The lock receiving portions 23 receive the locking members 31, respectively. The locking members 31 serve to lock the connector 1 and a mating connector (which is shown by reference numeral 61 in FIGS. 5 and 6) to each other after the connector 1 is connected to the mating connector.

The main body 22 has a plate-like fitting portion 25 to be fitted to a mating fitting portion of the mating connector, which will hereinafter be described. The fitting portion 25 has one surface on which the contacts 11 are arranged in parallel to one another in a longitudinal direction of the fitting portion 25 with a space left therebetween. The flat cable 51 has one end at which the conductors are exposed by removing the insulator cover 55. The conductors at the one end are connected to the contacts 11 in one-to-one correspondence.

Figure 4:
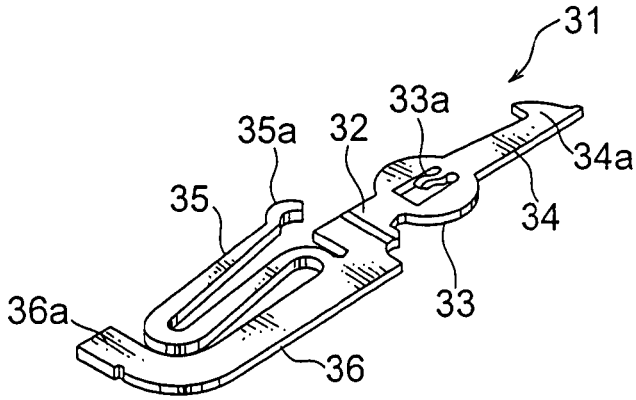
FIG. 4 is a perspective view of a locking member illustrated in FIGS. 1 and 2.

Referring to FIG. 4 also, the locking members 31 will be described.

Each of the locking members 31 has a holding portion 32, a shaft portion 33 connected to one side of the holding portion 32, a locking portion 34 extending from the shaft portion 33 to one side thereof, an operating portion 36 extending from the other side of the holding portion 32, and an operation spring portion 35 extending from the operating portion 36 and bent in a generally U shape. The operating portion 36 serves to make the locking portion 34 engage and disengage the connector 1 and the mating connector 61.

The locking portion 34 is a part to be engaged with a mating locking portion of the mating connector. The shaft portion 33 is provided with a spring portion 33*a* formed by cutting and raising a plate portion of the locking member 31. The locking portion 34 has a hook portion 34*a* formed at its end. The hook portion 34*a* is adapted to be engaged with a mating engaging hole 61*c* formed in a mating engaging portion 61*b* of the mating connector 61 when the connector 1 is fitted to the mating connector 61.

The operating spring portion 35 continuously urges the locking portion 34 in an engaging direction in which the connector 1 is engaged with the mating connector 61, and exerts a spring force to return the locking portion 34 to a normal position after a locked state by the locking portion 34 is unlocked into an unlocked state. The operating spring portion 35 serves to make the operating portion 36 be smoothly moved or operated.

The operating portion 36 has a free end 36*a* bent along a U-shaped portion of the operating spring portion 35. The operating spring portion 35 and the free end 36*a* of the operating portion 36 are located in the lock receiving portion 31 irrespective of the locked state or the unlocked state.

The locking member 31 can be formed by punching a metal plate by a press and then forming the spring portion 33*a* by cutting and raising.

Figure 5:
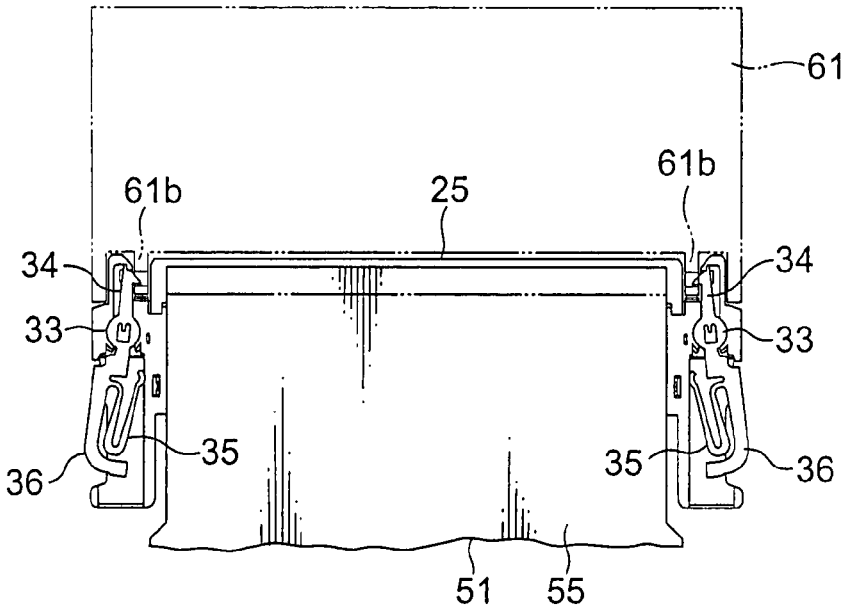
FIG. 5 is a sectional view taken along a line V-V in FIG. 2.
Figure 6:
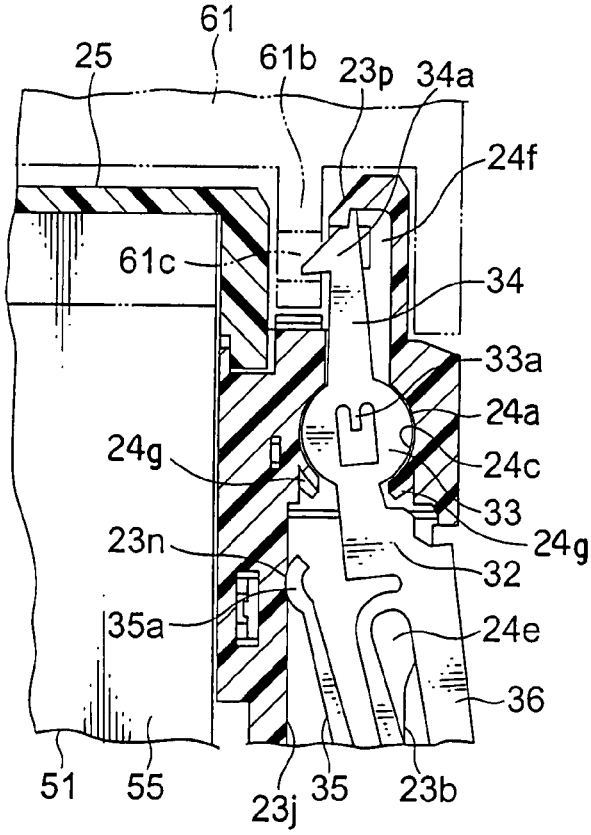
FIG. 6 is an enlarged sectional view of a part of a lock receiving portion and a locking member of the connector illustrated in FIG. 5.
Figure 7:
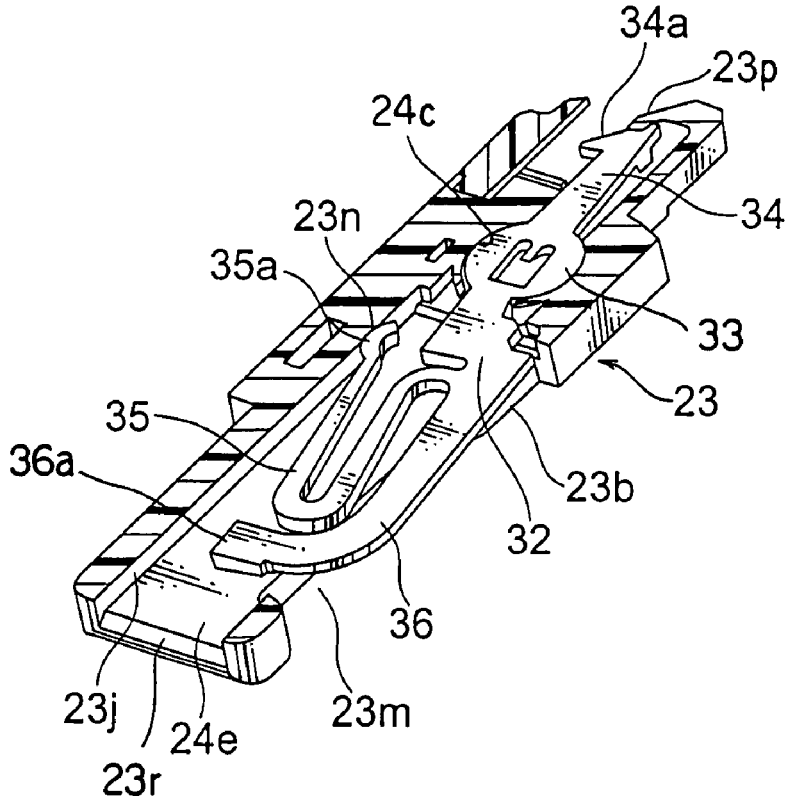
FIG. 7 is an enlarged sectional perspective view of a part of the lock receiving portion and the locking member illustrated in FIG. 5.

Referring to FIGS. 5 to 7, the locking member 31 is located at a locking position in the locked state. In the locked state in FIGS. 5 and 6, the connector 1 and the mating connector 61 depicted by two-dot-and-dash lines are fitted to each other and prevented from being released from each other.

Figure 8:
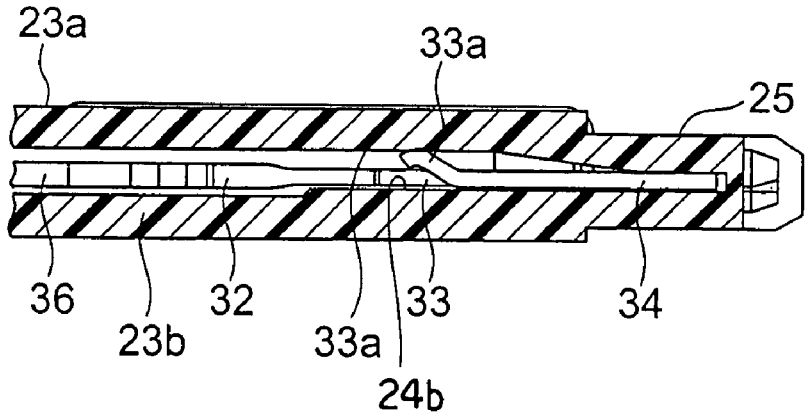
FIG. 8 is a sectional view taken along a line VIII-VIII in FIG. 1.

As shown in FIG. 8 also, each of the lock receiving portions 23 of the housing 21 comprises an upper plate portion 23*a*, a lower plate portion 23*b* faced to the upper plate portion 23*a* with a space left therebetween, and an inner wall portion 23*j* connecting the upper and the lower plate portions 23*a* and 23*b*. The lower plate portion 23*b* has an inner surface provided with a bearing potion 24*a* having a recessed shape and a generally circular shape in plan view and adapted to receive the shaft portion 33 of the locking member 31, a first receiving portion 24*e* adapted to receive the operating spring portion 35 and the operating portion 36, and a second receiving portion 24*f* adapted to receive the locking portion 34. The bearing portion 24*a* has a bottom surface 24*b* and a side surface 24*c* for guiding rotation of the shaft portion 33 of the locking member 31.

In the state where the locking member 31 is received in the lock receiving portion 23, the shaft portion 33 is received in the bearing portion 24*a* and rotatably held. Further, as shown in FIG. 8 also, the spring portion 33*a* presses the shaft portion 33 towards the bottom surface 24*b* of the bearing portion 24*a*.

Figure 9:
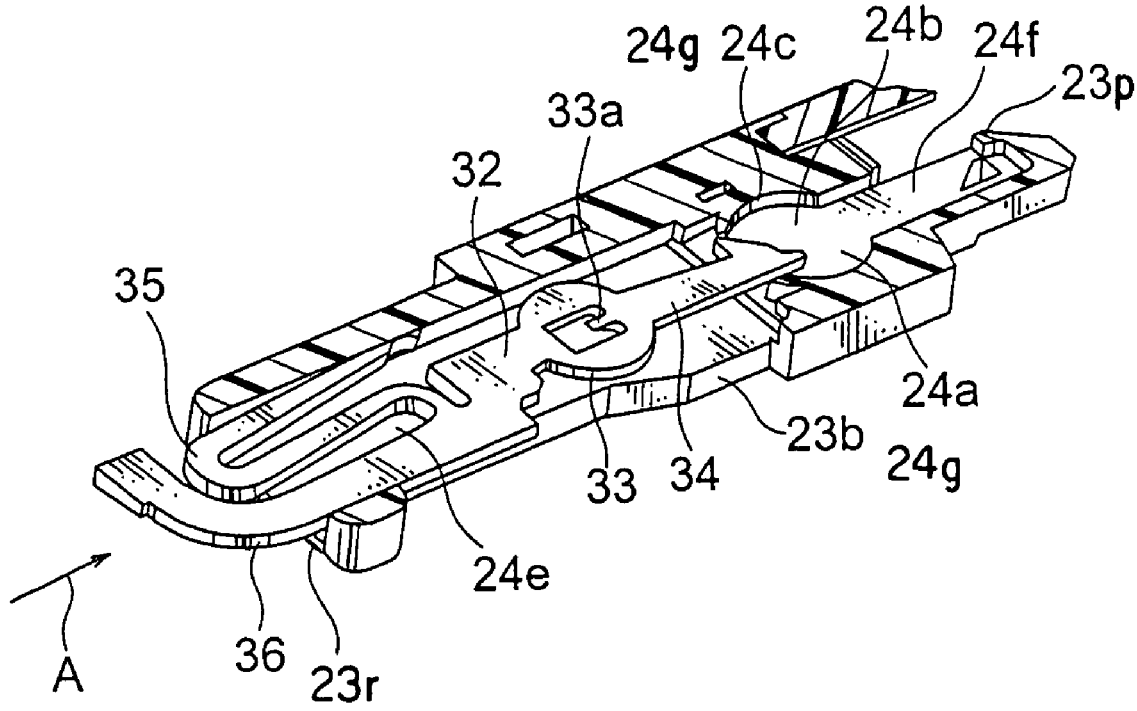
FIG. 9 is a sectional perspective view showing a state where the locking member is halfway inserted into the lock receiving portion of the connector illustrated in FIG. 7.

Referring to FIG. 9, the locking member 31 is halfway inserted before reaching a predetermined position of the lock receiving portion 23. The lock receiving portion 23 is provided with an inclined surface 24*g* formed on its insertion side so as to easily insert the shaft portion 33 of the locking member 31 to the bearing portion 24*a*. As shown in FIG. 9, when the locking member 31 is received in the lock receiving portion 23, the shaft 33 is engaged with the bearing portion 24*a* and the locking member 31 is rotatably held by the housing 21.

The first receiving portion 24*e* of the lock receiving portion 23 is provided with an inlet 23*r* corresponding to an inserting direction A of the locking member 31. The inlet 23*r* is formed at the first receiving portion 24*e* in the lock receiving portion 23 on the side opposite to a hook contacting portion 23*p*. When the locking member 31 is inserted through the inlet 23*r* with the hook portion 34*a* directed forward and the locking portion 34 is received in the second receiving portion 24*f*, the shaft portion 33 is fitted to the bearing portion 24*a*. In this state, the locking member 31 is held in the lock receiving portion 23 in the inserting direction A and a releasing direction opposite to the inserting direction A and held by the upper and the lower plate portions 23*a* and 23*b* in a vertical direction. The shaft portion 33 received in the bearing portion 24*a* becomes rotatable.

The holding portion 32 of the locking member 31, the shaft portion 33, the locking portion 34 except the hook portion 34*a*, and the free end 36*a* of the operating lever portion 36 are located inside the lock receiving portion 23 and prevented from being directly touched by a finger. Most part of the operating lever portion 36 of the locking member 31, except the free end 36*a*, protrudes through an opening 23*m* of the lock receiving portion 23 to the outside of the lock receiving portion 23.

The free end 35*a* of the operating spring portion 35 has a contact surface slightly inserted into a groove-like contact portion 23*n* formed on an inner wall surface 23*j* of the lock receiving portion 23. The groove of the contact portion 23*n* restricts vertical movement of the free end 35*a* to prevent deformation of the operating spring portion 35. The free end 36*a* of the operating portion 36 has an end face which is brought into contact with the inner wall surface 23*j* to prevent excessive pressing when the operating portion 36 is pressed and operated. The lock receiving portion 23 covers the locking member 31 in the vertical direction. In addition, in the inserting direction A, the locking member 31 is received in the lock receiving portion 23. Therefore, the locking member 31 is protected from an external force excepting an operating force acting to the operating portion 36. Further, the hook portion 34*a* of the locking member 31 is located near the locking portion 34. The lock receiving portion 23 is provided with the hook contact portion 23*p* to be brought into contact with the hook portion 34*a* at the locking position.

The shell member 41 comprises a first plate portion 43 attached to the main body 22 to face a first surface 22*a* of the main body 22, and a second plate portion 44 attached to the main body 22 to face a second surface 22*b* opposite to the first surface 22*a*. The shell member 41 is formed by punching and then bending a metal plate into a plate-like shape so as to cover the main body 22 except the lock receiving portions 23 and the fitting portion 25. From the state illustrated in FIG. 3, the first plate portion 43 is bent to be faced to the second plate portion 44 so that the first plate portion 43 is faced to the first surface 22*a*. The second plate portion 44 is faced to the second surface 22*b*. Thus, the shell member 41 is held by the main body 22.

The first plate portion 43 is provided with a plurality of claw portions 43*a* formed by cutting and raising the first plate portion 43. The claw portions 43*a* are brought into contact with the insulator cover 55 of the cable 51 through a plurality of windows 22*d* formed on the first surface 22*a* of the main body 22. The conductors at the one end of the cable 51 are connected to a part of the contacts 11 extending from the fitting portion 25 into the main body 22.

Now, description will be made of operations of locking and unlocking the connector 1 and the mating connector 61.

At first, from the locked state illustrated in FIGS. 1 and 5 to 7, the operating portion 36 is pushed towards the inner wall surface 23*j* of the housing 21 by a finger. Then, the operating spring portion 35 is displaced and the shaft portion 33 rotates in the bearing portion 24*a*. At this time, the locking portion 34 rotates in the second receiving portion 24*f* clockwise on the drawing sheet of FIG. 6. The hook portion 34*a* also rotates in the similar direction. Therefore, the hook portion 34*a* is released from the mating engaging hole 61*c* of the mating engaging portion 61*b* of the mating connector 61 so that the locked state is cancelled.

In the locked state by the locking member 31, the hook portion 34*a* is brought into contact with the hook contact portion 23*p* in the state where the free end 35*a* of the operating spring portion 35 enters into the contact portion 23*n* of the lock receiving portion 23 with a spring force. Therefore, the rotation of the locking member 31 is restricted to a predetermined rotation angle. In addition, the amount of protrusion of the hook portion 34*a* of the locking member 31 can be kept constant so that a stable locking strength is assured.

When the connector 1 and the mating connector 61 are fitted to each other and locked to each other, the mating engaging portion 61*b* of the mating connector 61 is inserted into the fitting portion 25 and between the lock receiving portions 23 when the locking member 31 is located at the locking position. By the above-mentioned operation, the locking portion 34 is pushed in the second receiving portion 24*f* by the mating engaging portion 61*b*. When the connector 1 and the mating connector 61 are fitted to each other and the hook portion 34*a* reaches the mating engaging hole 61*c* of the mating engaging portion 61*b*, the locking portion 34 rotates counterclockwise by the spring force of the operating spring portion 35 and the hook portion 34*a* is inserted into the mating engaging hole 61*c* to establish the locked state.

As described above, the shaft portion 33 and the bearing portion 24*a* are formed by only two components, i.e., each locking member 31 and the housing 21. The shell member 41 also serves to provide electric grounding and to enhance a mechanical strength of the housing 21. However, the connector 1 does not require the shell member 41 if electric grounding or the mechanical strength of the housing 21 need not be taken into account.

With the connector according to the exemplary embodiment mentioned above, the shaft portion 33 is received in the bearing portion 24*a* so that the locking member 31 is rotatably held. In addition, the spring portion 33*a* presses the shaft portion 33 towards the bottom surface of the bearing portion 24*a*. With this structure, the locking member 31 smoothly rotates and is prevented from being released from the housing 21.

Further, it is possible to maintain a constant amount of protrusion of the the hook portion 34*a* when it is rotated to the locking position. Therefore, the locked state can be securely maintained so that a stable locking strength is assured.

Further, simply by incorporating the locking member 31 into the lock receiving portion 23 of the housing 21, the shaft portion 33 is rotatably held by the bearing portion 24*a*. Therefore, the shaft portion 33 and the bearing portion 24*a* can be formed by only two components, i.e., each locking member 31 and the housing 21. It is therefore possible to simplify an assembling process and to reduce the number of components.

In the exemplary embodiment mentioned above, the spring portion 33*a* is formed at the shaft portion 33 of the locking member 31. However, the spring portion 33*a* may be formed near the shaft portion 33. Alternatively, such spring portion may be formed at the lock receiving portion 23 of the housing 21. In case where the spring portion is formed at the lock receiving portion 23, it is a matter of course that the shaft portion 33 is elastically pressed by the spring portion.

The above-mentioned connector may be implemented as a plug connector which supports high-speed transmission and which is for transmitting an electric signal from an apparatus body to an electronic apparatus as a connection object.

While the present invention has thus far been described in connection with the exemplary embodiment thereof, it will readily be possible for those skilled in the art to put this invention into practice in various other manners.

What is claimed is:

1. A connector comprising:

at least one contact;

a housing holding the at least one contact and having a lock receiving portion; and a locking member received in the lock receiving portion for locking a fitted state with a mating connector;

wherein:

the locking member includes a shaft portion;

the lock receiving portion includes a bottom surface faced to the shaft portion in its axial direction and a side surface for guiding rotation of the shaft portion; and at least one of the locking member and the lock receiving portion includes a spring portion pressing the shaft portion towards the bottom surface; wherein the locking member comprises:

a hook portion connected to the shaft portion and adapted to be engaged with the mating connector; and an operating portion connected to the shaft portion for operating the hook portion;

further comprising an operating spring portion connected to the shaft portion for urging the hook portion in a direction of engagement with the mating connector; and wherein the housing includes a hook contact portion for locking the movement of the hook portion in a direction of engagement with the mating connector.

2. The connector according to claim 1, wherein the hook portion and the operating portion extend from the shaft portion in directions opposite to each other.

3. The connector according to claim 1, wherein the operating spring portion extends from the operating portion and is engaged with the housing.

4. The connector according to claim 1, wherein at least a free end of the operating portion and the operating spring portion are located within the lock receiving portion irrespective of a position of the locking member.

5. The connector according to claim 1, wherein:

the lock receiving portion comprises an upper plate portion and a lower plate portion faced to each other with a space left therebetween; and the lower plate portion includes a bearing portion which is of a recessed shape and receives the shaft portion.

6. The connector according to claim 5, wherein the lower plate portion further includes:

a first receiving portion receiving the operating portion and the operating spring portion; and a second receiving portion receiving the locking member.

7. A connector comprising:

at least one contact;

a housing holding the at least one contact and having a lock receiving portion; and a locking member received in the lock receiving portion for locking a fitted state with a mating connector;

wherein:

the locking member includes a shaft portion;

the lock receiving portion includes a bottom surface faced to the shaft portion in its axial direction and a side surface for guiding rotation of the shaft portion; and at least one of the locking member and the lock receiving portion includes a spring portion pressing the shaft portion towards the bottom surface; and the shaft portion has a plate-like shape; and the spring portion is formed by cutting and raising a part of the shaft portion.

* * * * *